United States Patent [19]

Müller

[11] 4,455,923

[45] Jun. 26, 1984

[54] AIR CYLINDER WITH END POSITION DAMPING

[75] Inventor: Richard Müller, Mehlingen, Fed. Rep. of Germany

[73] Assignee: Pfaff Industriemaschinen GmbH, Fed. Rep. of Germany

[21] Appl. No.: 416,545

[22] Filed: Sep. 10, 1982

[30] Foreign Application Priority Data

Sep. 19, 1981 [DE] Fed. Rep. of Germany ..... 3137345

[51] Int. Cl.[3] ..... F15B 15/22

[52] U.S. Cl. ..... 91/394; 91/407

[58] Field of Search ..... 91/407, 404, 394, 405

[56] References Cited

U.S. PATENT DOCUMENTS

| | | | |
|---|---|---|---|
| 2,870,744 | 1/1959 | Hallerstrom | 91/407 |
| 3,162,092 | 12/1964 | Corwin | 91/407 |
| 3,998,132 | 12/1976 | Rasigade | 91/407 |
| 4,154,147 | 5/1979 | Cagle | 91/404 |

*Primary Examiner*—Paul E. Maslousky

*Attorney, Agent, or Firm*—McGlew and Tuttle

[57] ABSTRACT

An air cylinder has a main piston which is movable backwardly and forwardly under the control of air pressure and it is closed on at least one end with an axially extending damping bore which terminates in a closed end having a stop member adjacent this end. A vent hole connects to the interior of the cylinder to the damping bore and another vent hole connects into the cylinder main space. Each vent hole is advantageously connected to a throttle and check valve which permits inflow of air to the associated spaces and a throttled exit of the air depending on the position of the piston in the cylinder. The piston carries a damping piston in the form of a cylindrical extension thereof which is movable with the piston toward the closed end and has an open end with an axially extending damping bore therein having a check valve which closes the opening. The damping piston moves with the main piston so that adjacent the end position of movement of the main piston, the damping piston enters into the damping bore so as to bring its end into proximity to the stop which opens the check valve. The effect is to cause a slowing motion of the main piston until the stop reaches the check at which the main piston approaches substantially its end position at which time the remainder of the air trapped ahead of the main piston is exhausted through one or more of the vent holes.

6 Claims, 5 Drawing Figures

AIR CYLINDER WITH END POSITION DAMPING

FIELD AND BACKGROUND OF THE INVENTION

This invention relates in general to air or gas cylinders which have main pistons which move backwardly and forwardly to control admission of air and to a new and useful air cylinder having a main piston which includes means for damping its end movement to an end position.

Such an air cylinder has been described in a reprint of pages 33 ff from the Blue TR-Series, No. 26, with the title "Pneumatic and Hydropneumatic Control Technique", 1976, "Technische Rundschaue", published by Hallwag, Switzerland. In this air cylinder, a smooth braking of the moved masses is obtained by plunging a damping piston associated with the working piston into a damping bore at the end of the piston motion, whereby the vent hole which is provided at the end of the damping bore is closed. Now, the air must escape through another vent provided adjacent the end portion of the cylinder space accommodating the working piston and through a throttling valve connected thereto. Since only a limited air volume can pass through this throttling valve per unit of time, a back pressure builds up by which the piston motion is braked and the piston is prevented from butting hard against the end wall of the cylinder space.

With large masses and/or high speeds, the braking back pressure upstream of the throttling valve may increase to a multiple of the working pressure at the other side of the piston. Then, the working piston rebounds from the formed air cushion. This undesirable effect may be reduced by extending and/or enlarging the cylinder, yet can never be eliminated. Further this augmentation in size is unpracticable under limited space conditions.

SUMMARY OF THE INVENTION

The present invention is directed to an air cylinder design ensuring that no rebound occurs during the end position damping.

By designing the damping piston with a longitudinal bore closed by a check valve at one end and opening into a cross bore provided in the damping piston at a location closely adjacent the working piston, and by mounting a stop element at the end of the cylinder housing, by which the check valve is opened before the working piston reaches its end position, a communication with the normal vent hole is established during the damping or braking period, so that the air compressed between the working piston and the throttling valve can escape through the longitudinal bore and the check valve, and expand. With the other operating conditions remaining unchanged, thus without changes in the piston speed, the moved masses, and the air temperature, the opening period of the check valve may also remain unchanged and be chosen so as to obtain a satisfactory braking or damping of the piston motion and also to completely eliminate an excessive back pressure and thus rebounding of the working piston.

The inventive check valve and longitudinal bore in the damping piston have the further advantage that if the air cylinder is actuated in the opposite direction, thus air is supplied through the port which has previously been used for evacuating the air displaced by the working and damping pistons, the working pressure acts from the beginning not only on the damping piston but simultaneously, through the open check valve and the longitudinal bore, on the working piston, so that a higher initial operating speed is obtained.

The features wherein the check valve is designed as a ball retaining valve operating in the longitudinal direction of the damping piston, and that the stop element is embodied by an adjustable threaded pin which extends coaxially of the check valve are advantageous embodiments of constructional parts. By designing the stop element as an adjustable threaded pin, the instant of opening of the check valve can be varied and thus adapted to changed operating conditions.

Accordingly, it is an object of the invention to provide an air cylinder which has a main piston movable therein and a damping piston associated therewith which is hollow and includes an air space in its interior which is closed by a check valve and wherein during the movement of the main piston into an end position the damping piston slows its motion by moving into an axially extending damping bore which is of smaller diameter than the main piston and which includes an arrangement whereby when it comes substantially to the end position of movement, the check valve on its interior opens the interior space so as to vent the remaining air from the cylinder when the main piston comes into substantially an end position.

A further object of the invention is to provide an air cylinder which is simple in design, rugged in construction and economical to manufacture. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
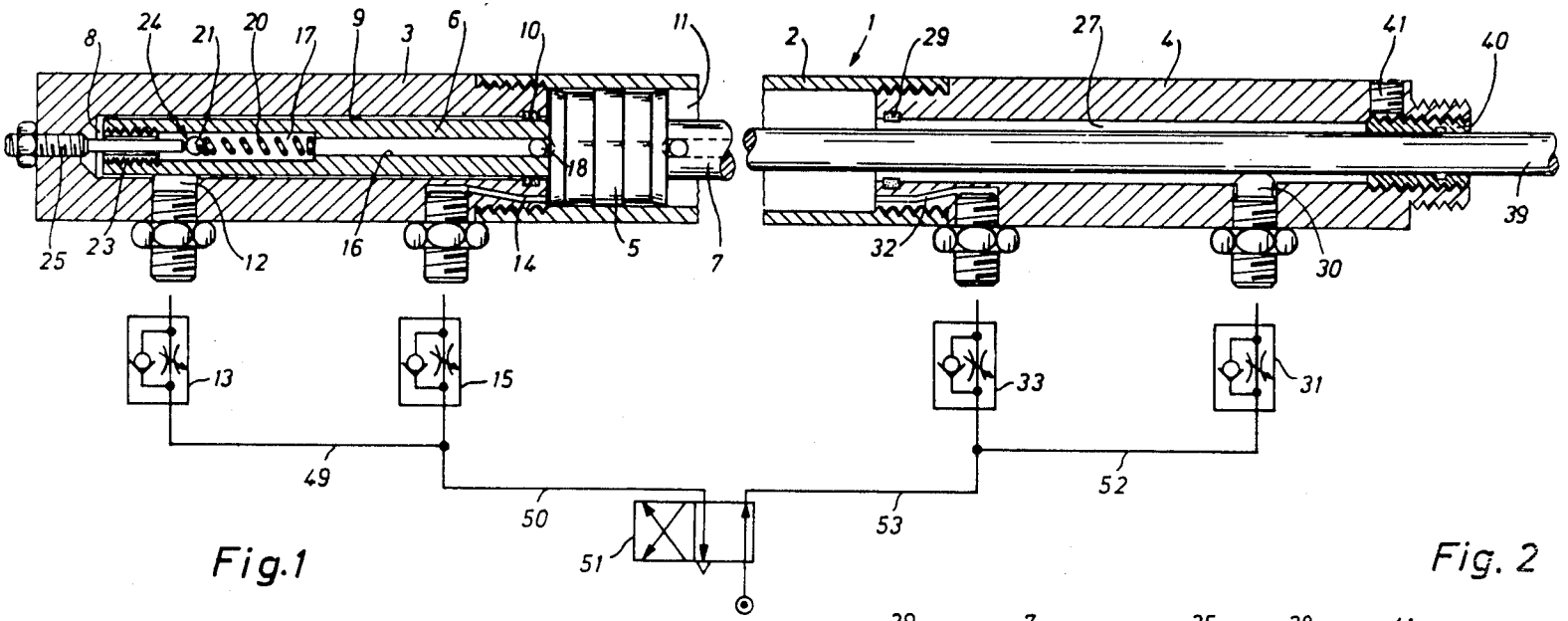
FIG. 1 is an axial sectional view of an air cylinder constructed in accordance with the invention including a diagrammatic showing of the air circuit for the cylinder operation.

Referring to the drawings in particular the invention embodied therein comprises an air cylinder generally designated 1 which comprises a cylinder member or tube 2 with a main cylinder space or portion 11 in which a main piston 5 is movable. The air cylinder 2 has an end 3 and 4 with at least one end portion, for example the end portion 3 having an axially extending damping bore 8 terminating in an inner closed end. A stop member 25 adjacent the closed end of the damping bore is located so as to enter into the hollow bore portion 17 of a damping piston 16 to open a check valve 24 when the main piston 5 approaches an end position. The construction includes a first vent hole 12 connected into the damping bore 8 intermediate the length of the bore and a second vent hole 14 connected into the main cylinder space 11. A combined throttle and check valve 13 is connected to the vent hole 12 and a combined throttle and check valve 15 is connected to the vent hole 14. Stop 25 is located so as to open the check valve 24 to permit inflow of air from the damping bore into the bore portion 17 and 16 of the damping piston 6 before the piston 5 reaches its end position in order to vent the damping bore 8 and the space ahead of the working piston. The throttle valves 13 and 15 are sized to provide the desired outflow of air as are the vent holes 12 and 14.

The air cylinder comprises the housing 1 formed by the cylindrical tube 2 and two end pieces 3,4. In tube 2, the working piston 5 is received which is connected at both its sides to damping pistons 6,7 having a smaller diameter.

End piece 3 is designed with the lengthwise cavity, further termed the damping bore 8, having a diameter exceeding the diameter of damping piston 6, so that a relatively large annular gap 9 is formed therebetween. Gap 9 is sealed against the cylinder space 11 accommodating working piston 5 by a packing ring 10 received in the end piece 3. The end piece 3 is provided with a relatively wide vent hole 12 opening into damping bore 8 and connected to a throttle check valve 13. Valve 13 has a relatively widely adjusted throttling gap, so that a relatively small resistance opposes the air passing therethrough. End piece 3 is further provided with a relatively narrow vent passage 14 opening to cylinder space 11 at one side and connected to a throttle check valve 15 at the other side. Valve 15 has a relatively narrowly adjusted throttling gap, so that a relatively high resistance opposes the air passing therethrough.

Figure 3:
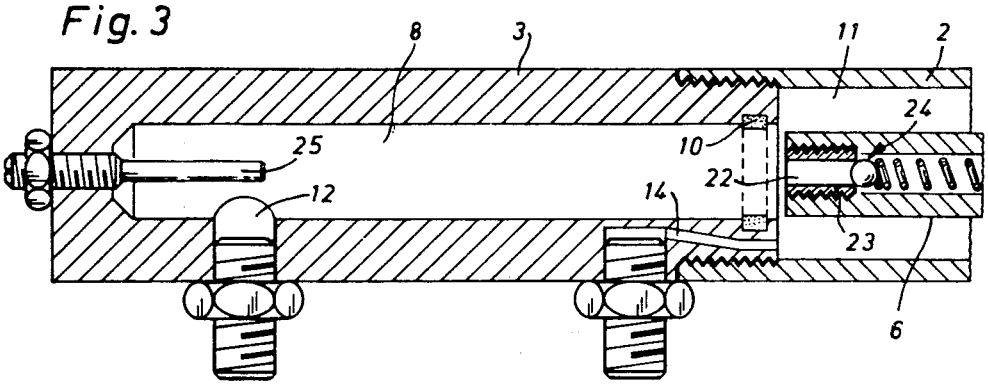
FIG. 3 is an enlarged sectional view of the left hand portion of the cylinder shown in FIG. 1 before the start of the piston braking.
Figure 4:
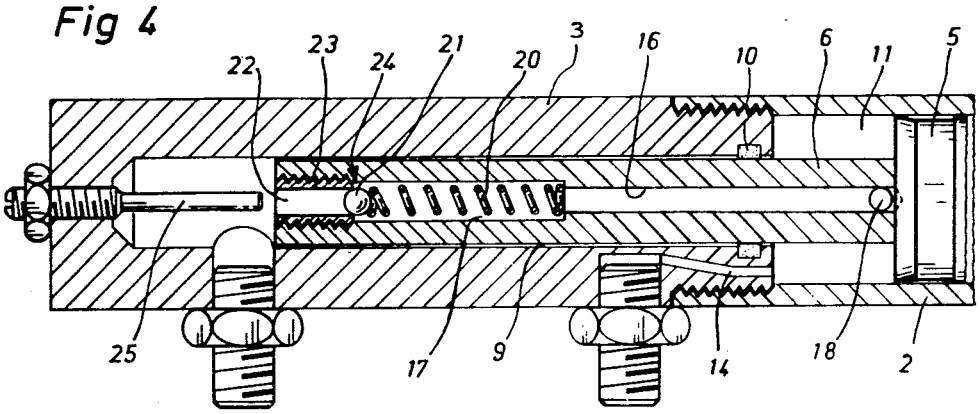
FIG. 4 is a view similar to FIG. 3 showing an advance position of the braking of the main piston.

Damping piston 6 is designed with a lengthwise bore 16 opening at one end into a coaxial lengthwise bore 17 of larger diameter, and communicating at its other end with a cross bore 18 which is located closely adjacent working piston 5. Bore 17 accommodates a compression spring 20 and a ball 21. A threaded bushing 23 with a lengthwise bore 22 (FIG. 3) and forming a seat for ball 21 is screwed into the end portion of damping piston 6. Spring 20, ball 21, and bushing 23 form a check valve 24.

Figure 5:
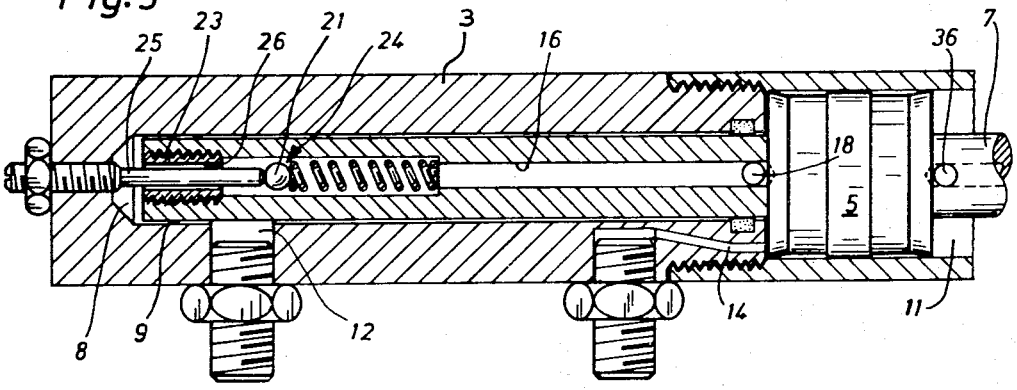
FIG. 5 is a view similar to FIG. 3 showing the end position of the main piston.

An adjustable threaded pin 25 is screwed into the front end portion of end piece 3, having a diameter which is smaller than that of bore 22 of sleeve 23, so that a relatively wide annular gap 26 (FIG. 5) is formed between bore 22 and pin 25.

End piece 4 is designed with a damping bore 27 having a diameter exceeding that of damping piston 7 (FIG. 2), so that a relatively wide annular gap 28 is formed between damping bore 27 and damping piston 27. Gap 28 is sealed against cylinder space 11 by a packing ring 29 received in end piece 4.

End piece 4 is provided with a vent hole 30 opening into damping bore 27 and connected to a throttle check valve 31. Valve 31 has a relatively wide throttling gap. End piece 4 is further provided with a relatively narrow vent passage 32 which opens into cylinder space 11 at one side and is connected to a throttle check valve 33 at its other side. Valve 33 has a relatively narrow throttling gap.

The design of damping piston 7 is similar to that of damping piston 6. More particularly, piston 7 is provided with a lengthwise bore 34 (FIG. 2) opening to a check valve 35 at one side and into a cross bore 36 at its other side. Cross bore 36 is located closely adjacent working piston 5. Damping piston 7 differs from damping piston 6 in that a threaded extension 38 of a piston rod 39 is screwed into its end portion instead of a threaded bushing.

Piston rod 39 is guided in a threaded bushing 40 which is screwed into end piece 4 to an adjustable depth and can be arrested in position by a clamping screw 41. Piston rod 39 is designed with a lengthwise blind bore 42 which extends from the threaded extension 38 relatively deeply into the piston rod. Directly adjacent the threaded extension 38, piston rod 39 is provided with a throughgoing oblong slot 43. A displaceable pin 44 having a portion 45 with a smaller diameter is received in lengthwise bore 42. The diameter of pin portion 45 is smaller than that of bore 42 so that a relatively wide annular gap 46 is formed. Pin 44 carries a cross pin generally designated 47 which is longer than the diameter of piston rod 39, so that two stop dogs 48 are formed. Throttle check valves 13,15 are connected through a line 49 to each other and through a line 50 to a 4/2 directional control valve 51. Throttle check valves 31,33 are connected through a line 52 to each other and through line 53 to the same directional control valve 51.

The air cylinder operates as follows: With working piston 5 to be moved from its right-hand end position shown in FIG. 2 into its left-hand position shown in FIG. 1, control valve 51 is switched into the shown position, whereby compressed air is supplied thorugh lines 53,52, valves 31,33, and vent holes 30,32 into damping bore 27 at the righ-hand portion of cylinder space 11.

During the displacement thereby effected of working piston 5 and damping pistons 6,7 connected thereto, the air present in the left-hand portion of cylinder space 11 is displaced and escapes (FIG. 3) through damping bore 8 and the wide vent hole 12 to throttle check valve 13. Since a wide throttling gap is adjusted at valve 13, working piston 5 can displace a large amount of air within a short period of time. By varying the throttle gap, the amount of displaced air and thus the piston speed can be varied.

As soon as damping piston 6 plunges into damping bore 8 and packing ring 10 shuts off annular gap 9 of the remaining portions of damping 8 relative to cylinder space 11, just the air amount displaced by damping piston 6 can continue to escape substantially unhindered through vent hole 12 and throttle check valve 13. The air further displaced by the working piston 5, on the contrary, can escape only through the narrow vent passage 14 and throttling check valve 15. Since passage 14 having a small cross section already produces a throttling effect and, especially, a narrow throttling gap is adjusted in valve 15, the escaping amount of air is smaller than that which is displaced during the same period of time by working piston 5. Consequently, the air trapped between working piston 5 and throttle check valve 13 is being compressed. A quickly increasing back pressure builds up opposing the working pressure of the compressed air at the further side of working piston 5 and the motion of the piston is braked. Threaded pin 25 is engaged to a depth such that at an instant at which the piston motion is braked down to almost zero, the pin buttts against and retains ball 21 of check valve 24. Consequently, before the working piston can rebound from the air cushion, check valve 24 opens (FIG. 5), whereupon the compressed air trapped between working piston 5 and throttle check valve 15 as well as in the cross bore 18 and the lengthwise bores 16,17 quickly escapes through the annular gap 26, the still not completely filled portion of the damping bore 8, and the annular gap 9, into the vent hole 12 and therefrom to throttle check valve 13. The working piston 5 then moves farther through the remaining short path of travel until it is stopped, without any impact, by the inner front face of end piece 3.

Figure 2:
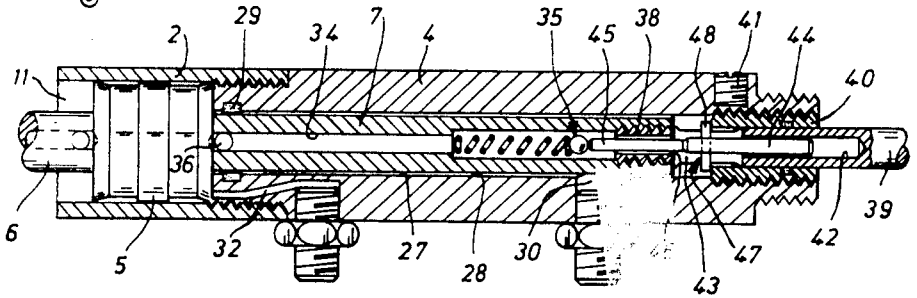
FIG. 2 is a partial view similar to FIG. 1 showing the main piston of the air cylinder in an opposite end position.

To return working piston 5 into its right-hand end position according to FIG. 2, directional control valve 51 is switched into its other position so that compressed air is supplied to the air cylinder through lines 50,49 and throttle check valves 13,15. Since the vent passage 14 has a small cross section, only a small part of the supplied air passes into the cylinder space 11 in this way. The by far largest part of the compressed air flows through vent hole 12 and the relatively wide annular gap 9 into damping bore 8 and acts directly on the front face of damping piston 6. However, the air also flows through the open check valve 24 and bores 16,17,18 into cylinder space 11 to again act directly on working piston 5. Therefore, already at the start of the piston motion, the entire piston area is exposed to the working pressure and a high starting speed is obtained.

Toward the end of the piston motion, damping piston 7 enters the damping bore 27, whereupon the piston motion is braked in the same manner as in the opposite direction. Thus, again the respective portion of damping bore 27 is shut off from cylinder space 11 as damping piston 7 plunges therein, and the air displaced by working piston escapses only slowly through the narrow vent passage 32 and throttle check valve 33, and is therefore compressed.

The threaded bushing 40 is screwed in to such a depth that at the instant at which the piston motion is braked to almost zero, the ball of check valve 35 is retained by butting against pin 44 which is backed up by threaded bushing 40 through stop dogs 48. Before working piston 5 can rebound from the air cushion, check valve 35 opens and the compressed air quickly flows through annular gap 46 and oblong slot 43 into the still not completely filled portion of damping bore 27, and escapes therefrom through annular gap 28, vent hole 30, and throttle check valve 31. Working piston 5 then completes its travel until it is stopped, without any impact, by the inner front face of end piece 4. During this motion, piston rod 39 is displaced relative to pin 44 and oblong slot 43 is displaced relative to stop dogs 48.

While a specific embodiment of the invention has bene shown and described in detail to illustrate the application of the principles of the invention, it will be understood that the invention may be embodied otherwise without departing from such principles.

What is claimed is:

1. An air cylinder, comprising a cylinder member having a main cylinder portion with a main cylinder space, an end portion closing one end of said space and including an axially extending damping bore terminating in an inner closed end and connecting with said space, a stop member adjacent said inner closed end of said damping bore, a first vent hole connected into said damping bore intermediate the length of said damping bore, a second vent hole connected into said main cylinder portion, a first throttle valve connected to said first vent hole, a second throttle valve connected to said second vent hole, a main piston movable in said space, a damping piston carried by said main piston and movable therewith in front of said main piston toward said inner closed end and having an an axially extending damping piston bore therein communicating with said space and having an open end, a check valve in said damping piston bore closing said end opening of said damping piston bore, said damping piston being moved with said main piston so that adjacent end position of movement of said main piston, the damping piston enters into said axially extending damping bore and engages said stop member with said check valve to open said check valve to permit inflow of air from the damping piston bore into said damping bore so as to vent the damping bore and the space of said main cylinder member ahead of said main piston through said first vent hole.

2. An air cylinder according to claim 1, wherein said check valve comprises a member defining a valve seat, a check ball retained on said valve seat, said stop member extending axially engaging said ball to move it off said valve seat.

3. An air cylinder according to claim 1, wherein said stop member includes a cylindrical bushing in said cylinder at the inner end of said damping bore, a rod member displaceable in said bushing and having a hollow portion opening to the interior of the damping bore, a displaceable pin in said hollow portion of said rod member having an outer end engageable with said check valve, said check valve including a ball displaceable by the outer end of said pin, and a stop dog carried by said displaceable pin and means defining end stops at spaced axial locations in said damping bore limiting the movement of said pin.

4. An air cylinder according to claim 3, wherein said bushing is threaded into said main cylinder end portion and it is sealingly engageable with said rod.

5. An air cylinder according to claim 1, wherein said air cylinder has two end portions each having damping bore therein, said main piston carrying a damping piston on each side thereof adapted to extend into a respective damping bore at each end position.

6. An air cylinder according to claim 1, wherein said second vent hole comprises a small vent passage connected into the end of said main cylinder space, said damping piston including a cross bore venting the interior bore of said damping piston into said damping bore, said damping piston leaving an annular space in said damping bore with a flow of fluid to said first vent hole.

* * * * *